US008220213B2

(12) United States Patent
Jolly

(10) Patent No.: US 8,220,213 B2
(45) Date of Patent: Jul. 17, 2012

(54) TOWER FOUNDATION

(76) Inventor: Tony Jolly, Houston, TX (US)

( * ) Notice: Subject to any disclaimer, the term of this patent is extended or adjusted under 35 U.S.C. 154(b) by 778 days.

(21) Appl. No.: 12/317,063

(22) Filed: Dec. 18, 2008

(65) Prior Publication Data

US 2009/0158680 A1 Jun. 25, 2009

Related U.S. Application Data

(60) Provisional application No. 61/008,742, filed on Dec. 21, 2007.

(51) Int. Cl.
*E02D 27/38* (2006.01)

(52) U.S. Cl. ..... 52/292; 52/298; 52/651.01

(58) Field of Classification Search ..... 52/292, 52/294–298, 745.04, 651.01, 831
See application file for complete search history.

(56) References Cited

U.S. PATENT DOCUMENTS

| | | | | |
|---|---|---|---|---|
| D55,135 | S * | 5/1920 | Maxwell | D12/345 |
| 1,366,179 | A | 1/1921 | Heckle | |
| 3,803,855 | A * | 4/1974 | Malkiel | 405/210 |
| 3,924,413 | A | 12/1975 | Marsh | |
| 4,217,738 | A | 8/1980 | Smith | |
| 4,218,859 | A | 8/1980 | Sams | |
| 4,232,846 | A | 11/1980 | Bressani | |
| 5,338,499 | A | 8/1994 | Ryynanen | |
| 5,586,417 | A | 12/1996 | Henderson et al. | |
| 5,826,387 | A | 10/1998 | Henderson et al. | |
| 6,672,023 | B2 | 1/2004 | Henderson | |
| 7,755,210 | B2 * | 7/2010 | Kammer et al. | 290/44 |
| 2002/0194794 | A1 * | 12/2002 | Hill et al. | 52/40 |
| 2003/0151260 | A1 * | 8/2003 | Siegfriedsen | 290/44 |
| 2004/0111991 | A1 * | 6/2004 | Swinimer | 52/294 |
| 2004/0154236 | A1 | 8/2004 | Kinzer | |
| 2004/0226236 | A1 * | 11/2004 | Pidgeon | 52/236.2 |
| 2006/0140761 | A1 * | 6/2006 | LeMieux | 416/61 |
| 2007/0124025 | A1 * | 5/2007 | Schram et al. | 700/287 |
| 2008/0217022 | A1 * | 9/2008 | Deans | 166/338 |

FOREIGN PATENT DOCUMENTS

| | | |
|---|---|---|
| DE | 3707641 | 12/1987 |
| WO | 0236898 | 5/2002 |

* cited by examiner

*Primary Examiner* — William Gilbert
*Assistant Examiner* — Alp Akbasli
(74) *Attorney, Agent, or Firm* — D'Ambrosio & Menon, PLLC

(57) ABSTRACT

Non-cementitious tower foundations and structures, kits and methods for making the non-cementitious tower foundations. Aspects of the present invention operate to decouple the required mass for the foundation from the structural components needed to resist compression and tension forces. Aspects of the present invention include a foundation structure made of structural components for resisting the expected forces transferred from the tower. This foundation structure may be filled with non-cementitious fill of any type to provide the required mass to stabilize the foundation and the tower. A non-cementitious tower foundation structure includes a central shaft; a storage tank; and structural members coupling the central shaft to the storage tank. The storage tank comprises one or more voids for containing non-cementitious fill as ballast to stabilize the central shaft. The total volume capacity of the voids may be at least a threshold volume.

23 Claims, 4 Drawing Sheets

Section View 3-3

Section View 3-3

TOWER FOUNDATION

PRIORITY CLAIM

This application claims the benefit of prior provisional U.S. application Ser. No. 61/008,742 of the application for a Tower Foundation filed Dec. 21, 2007.

FIELD OF THE INVENTION

A foundation for a tower.

BACKGROUND

Harnessing wind energy is becoming more widespread and acceptable as a viable means of generating electrical power for industrial and consumer uses. Large scale capture and conversion of wind energy requires the placement of wind turbines at a suitable elevation above the ground to capture the wind flow free from the interference and turbulence caused by the terrain surface. To achieve placement at such height, towers are used to support the wind turbines at the proper elevation. The towers are subjected to high winds that create tensile forces on the windward side of the tower and compression forces on the leeward side. These forces can be transferred to the foundation. Due to the small electrical generation capacity of each individual wind turbine, numerous towers are typically required.

SUMMARY

The typical method of constructing foundations for the wind turbine towers involves pouring a concrete base to support each of the towers. The concrete is poured into a plurality of forms containing tons of rebar. This requires the foundation be built at the construction site where it is subject to weather conditions, crew availability, and other factors which may lead to delay. Because the construction of the foundations are often on the critical path for the project any delays can impact project completion and have considerable negative financial consequences.

Costs and logistics for transporting concrete are high, and the wind turbines are often installed in remote areas where locally sourced concrete may not be available. Constructing tower foundations is usually carried out by setting up a cement batch plant at the construction site. This method of tower foundation construction still requires the transport of large amounts of water, dry cement, and rebar to the location, which increases construction costs.

Once constructed, it is very difficult to inspect the interior of the foundation and determine if any fatigue or corrosion damage is occurring. At the end of the project it is difficult and expensive to remove the concrete foundations. If the foundation is left on the location it results in ongoing legal exposure and site monitoring requirements. A substantial mass of concrete (reinforced with rebar) is required in typical foundations to stabilize the tower against lifting forces resulting from loads transferred from the tower to the foundation. Concrete has a large carbon footprint, which may be detrimental to the environment.

Aspects of the present invention operate to decouple the required mass for the foundation from the structural components needed to resist compression and tension forces. Aspects of the present invention include a foundation structure made of structural components for resisting the expected forces transferred from the tower. This foundation structure may be filled with non-cementitious fill of any type to provide the required mass to stabilize the foundation and the tower. Avoiding concrete decreases the cost and carbon footprint of the tower. The fill may be soil or aggregate local to the tower site, increasing efficiency. Specific embodiments of the present invention may include a foundation structure that is pre-fabricated or which may be easily assembled from a kit. Aspects of the present invention thus enable foundations that can be constructed off of the critical path.

In one general aspect, a non-cementitious tower foundation structure is disclosed. The foundation structure includes a central shaft; a storage tank; and structural members coupling the central shaft to the storage tank. The storage tank comprises one or more voids for containing non-cementitious fill as ballast to stabilize the central shaft. The total volume capacity of the voids may be at least a threshold volume. The threshold volume is a volume of a particular fill of a particular average density such that the weight of the volume of the particular fill is sufficient to counteract expected tension-based lifting forces. The structural members comprise a top surface corresponding to the top surface of the peripheral shell and adjacent side surfaces. The side surfaces span the depth of the peripheral shell along the entire length of the structural members. The structural members may be configured to transfer compression loads and tension loads from the central shaft to the storage tank such that the transferred tension loads result in lifting forces on portions of the storage tank.

In specific embodiments, the storage tank comprises a bottom member including a top surface. The storage tank may also comprise a peripheral shell including a bottom surface, with the bottom surface being attached to the perimeter of the top surface of the bottom member. The bottom member may comprise material of sufficient strength and thickness to support at least the weight of the threshold volume of fill.

Other general aspects of the invention include a foundation comprising the foundation structure described above and a kit which may be assembled into the foundation structure, as well as methods for constructing a foundation and making the disclosed foundation structure.

BRIEF DESCRIPTION OF THE DRAWINGS

So that the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention relates to a system for constructing a modified mass foundation for a tower on site from prefabricated non-cementitious materials and using non-cementitious materials as fill to provide mass ballast for the foundation. The fill may be obtained locally to the construction site or from the construction site itself. In some instances, the fill may be obtained as a byproduct of the construction itself. To construct the tower foundation, a pit is excavated below the ground surface and the foundation structure is assembled inside the pit from pre-manufactured parts or positioned in the pit pre-assembled. In some implementations, the foundation structure is positioned on level ground, with no excavation required. Once the assembled foundation structure is in place, the foundation structure is at least partially filled with local fill materials to complete the foundation. The local materials may include, for example, backfill from the excavation of the pit.

Figure 1:
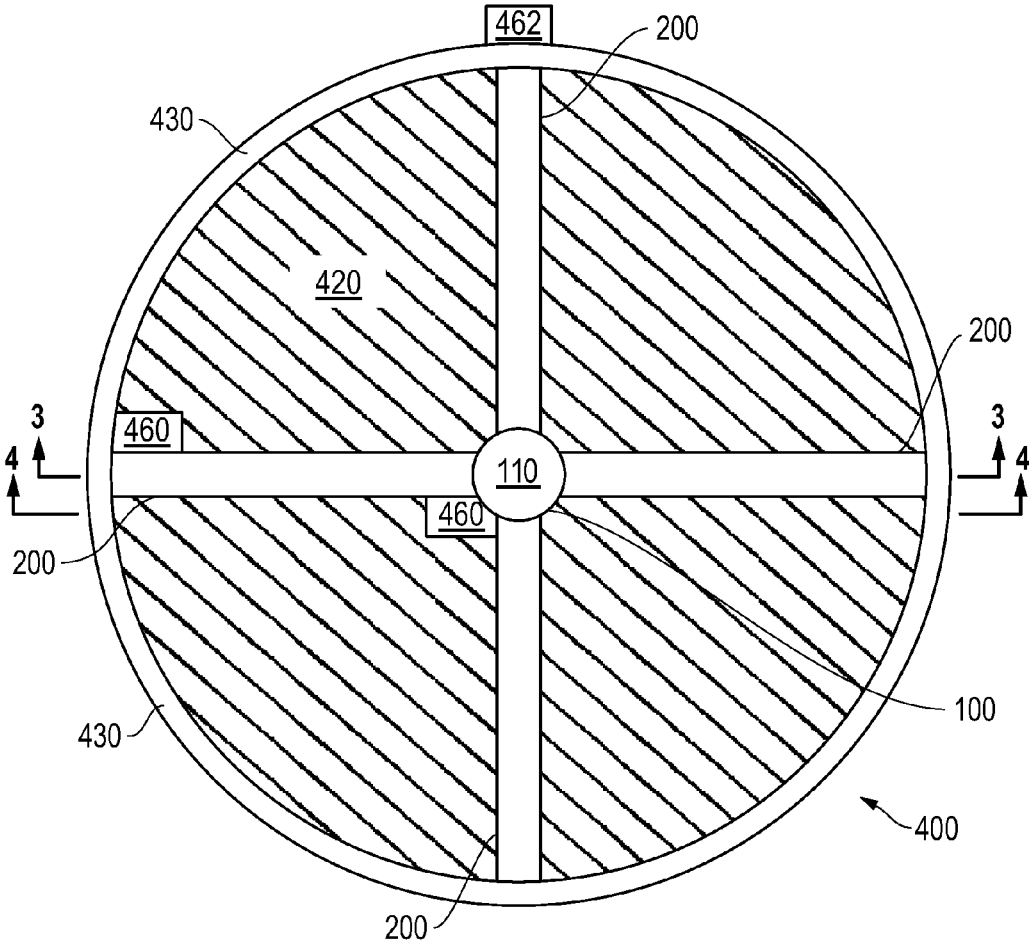
FIG. 1 is a top view of a foundation structure according to an embodiment of the invention.
Figure 2:
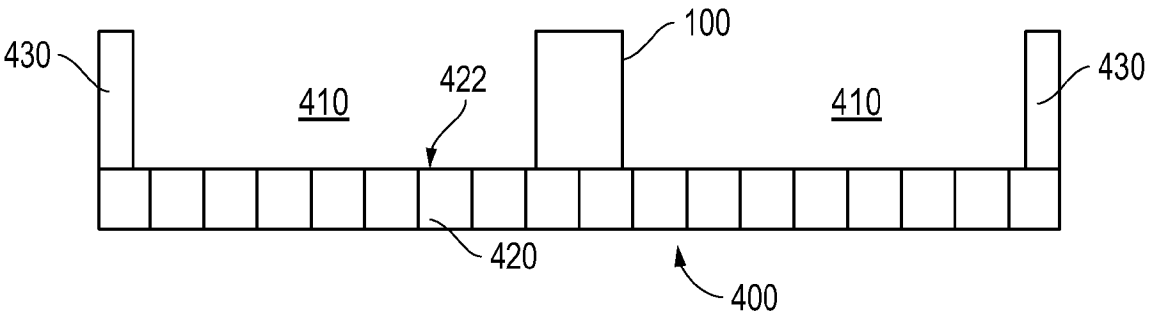
FIG. 2 is a cross sectional view of a foundation structure along voids of the foundation structure according to an embodiment of the invention.
Figure 3:
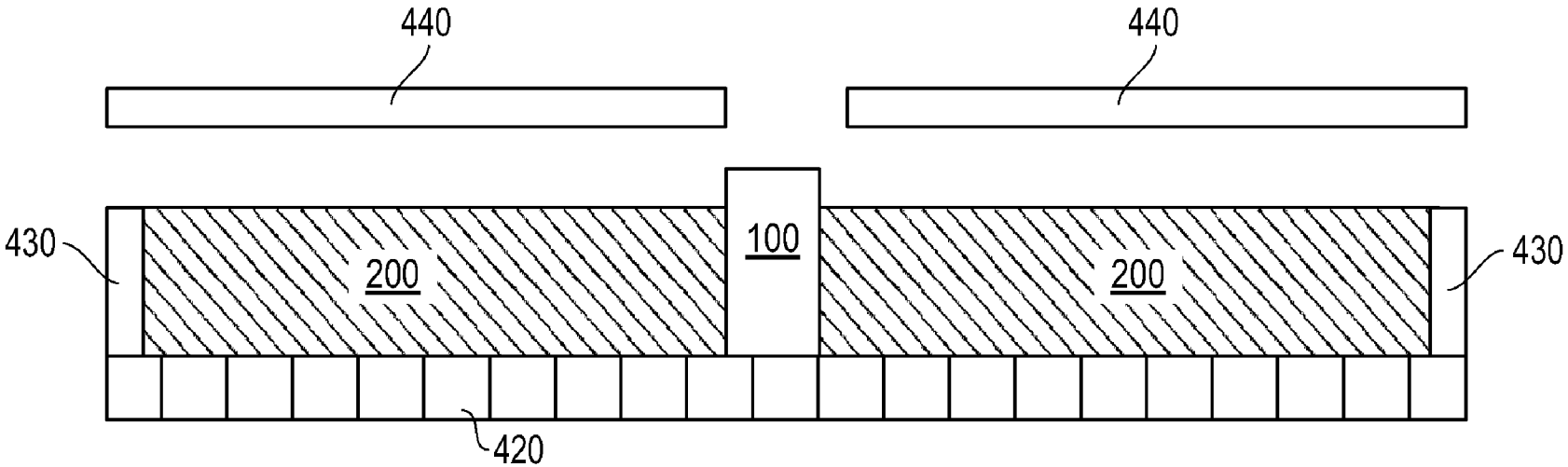
FIG. 3 is a cross sectional view of a foundation structure along structural members of the foundation structure according to an embodiment of the invention.

Referring to FIGS. 1-3, the foundation structure is a vessel that provides structural strength while holding the mass required to stabilize the foundation structure with the tower mounted thereon. The foundation structure is constructed from a central shaft 100, a storage tank 400, and structural members 200 coupling the central shaft 100 to the storage tank 400. The central shaft 100 may be of a large enough diameter to match the tower to be mounted on the foundation structure and long enough to span the entire depth of the foundation structure. A fastening member 110 is located at the top of the central shaft for making the connection between the foundation structure and the base of the tower. Any suitable method or combination of methods for fastening the tower to the foundation may be used, including but not limited to: bolts, studs, welding and/or threaded receivers.

Referring to FIGS. 1 and 3, a number of structural members 200 span radially from the central shaft 100 to the storage tank 400. In various embodiments, these structural members 200 may be steel plates, rods, I-beams, etc., and may be placed in various numbers, groupings, and spacing depending on the required size of the foundation. The structural members 200 may be coupled to the central shaft 100 and the storage tank 400 by bolts, studs, threaded receivers, welds, and so on. The structural members 200 transfer compression loads and tension loads from the central shaft 100 to the storage tank 400.

Figure 5:
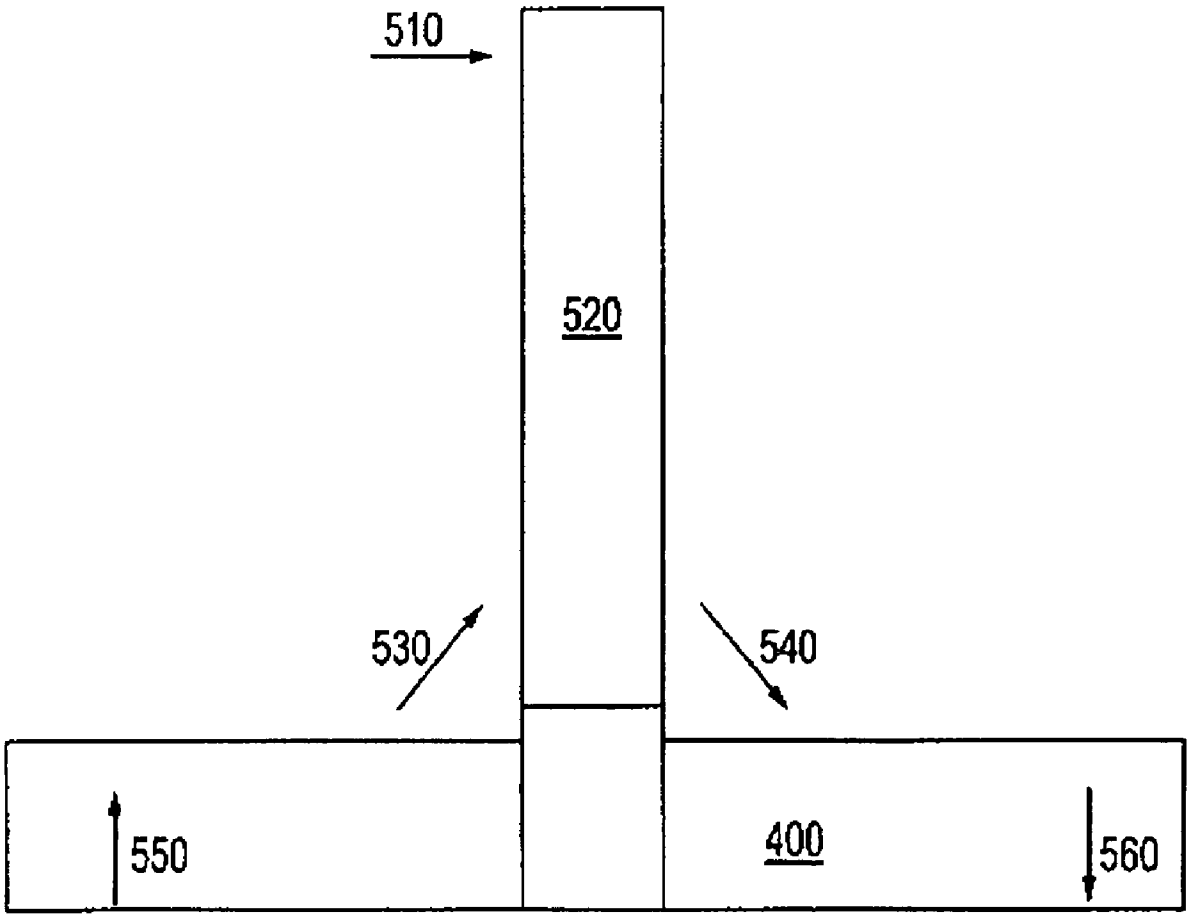
FIG. 5 is a force diagram of a tower coupled to a foundation according to an embodiment of the invention.

FIG. 5 illustrates typical loads on a tower connected to a foundation of the present disclosure. Referring to FIG. 5, winds apply a force 510 to the tower 520. The windward side of the tower bears a tensile load 530 and the leeward side of the tower bears a compression load 540. Structural members 200 in the foundation structure transfer the loads to the storage tank 400. The transferred loads result in a lifting force 550 on the windward side of the storage tank 400 and a downward force 560 on the leeward side of the storage tank 400. The downward force 560 on the storage tank 400 is resisted by the earth underneath the storage tank 400. The lifting force 550 is resisted by the weight of storage tank 400 along with the fill 300 contained within the storage tank 400, as described below.

Returning to FIG. 2, storage tank 400 comprises one or more voids 410. The voids 410 are configured to contain non-cementitious fill (300, FIG. 4) as ballast. In some embodiments, the total volume capacity of the voids 410 is at least a threshold volume. The threshold volume is a volume of fill of a particular average density such that the weight of the volume of fill is sufficient to counteract expected tension-based lifting forces, such as those resulting from high winds on the tower attached to the foundation. These expected tension-based lifting forces are a function of the height of the tower to be mounted and also the aerodynamic characteristics of the tower's particular shape in addition to the size and shape of the planned wind turbine generator and nacelle to be mounted on the tower. Thus, the threshold volume varies in dependence upon the density of the particular fill 300 to be used and in dependence upon the size and design of the tower 520. A first storage tank designed to be filled with hematite or barite would require less volume than another storage tank designed to be filled with gravel, because hematite and barite have a higher density. Thus, the threshold volume would be lower for the first storage tank. Tension force estimates for the tower 520 may be calculated according to height and general design. The weight of fill 300 required to counteract the tension force estimates may then be calculated. In one example for a typical tower design, the weight of fill 300 is set to equal the weight of the tower 520. The weight may be converted to a volume using the average density of the fill 300 (with a margin of safety added) to determine the threshold volume.

In FIGS. 1 and 2, the storage tank 400 includes bottom member 420 and peripheral shell 430. The peripheral shell 430 includes a bottom surface (not shown). The bottom surface of the peripheral shell 430 is attached to the perimeter of the top surface 422 of the bottom member 420. At the base of the storage tank 400 and the central shaft 100, bottom member 420 serves as the base of the foundation. Bottom member 420 is a circular plate.

Referring to FIG. 3, structural members 200 span the depth of the peripheral shell 430 and couple the central shaft 100 to the peripheral shell 430. Structural members 200 also couple the central shaft 100 to the bottom member 420 of the storage tank. The central shaft 100 joins with the top surface 422 of bottom member 420 to form the bottom of the foundation. The bottom member 420 comprises material of sufficient strength and thickness to support at least the weight of the threshold volume of fill. The storage tank may comprise an enclosed shell, including a top 440. Top 440 is flat ring comprised of one or more plates. Top 440 has a central cutout (not shown) which allows for the central shaft or the tower to pass through. Top 440 may be attached to peripheral shell 430 and central shaft 100. Any suitable method or combination of methods for fastening the top to the storage tank may be used, including but not limited to: bolts, studs, welding and/or threaded receivers.

The storage tank 400 is shown to be approximately cylindrical. The storage tank 400 may be other shapes in other embodiments. The foundation structure 400 may be any shape so long as the foundation has one or more voids 410 and is capable of supporting the tower. The particular shape of the storage tank in a specific embodiment is a result of particular design considerations. For example, a cylindrical shape may have a desirable volume efficiency, while a rectangular shape may increase ease of manufacture and assembly. The bottom plate may be various shapes, such as rectangular, elliptical, or any other shape as will occur to those of skill in the art.

In some implementations, central shaft 100 does not directly connect the bottom plate. Also, the structural members 200 may couple the central shaft 100 to the top 440 of the storage tank 400. In some embodiments, the bottom member 420 varies in three dimensions (e.g, a basin shape).

The material used to make the foundation may be determined by the use and conditions surrounding the tower. In some aspects, the components of the foundation structure comprise steel, such as carbon steel or stainless steel. For example, the structural members 200 may comprise steel plates, rods, or beams. Protective coatings may be applied to prevent corrosion. Other materials may be used in conjunction with steel. For example, in a location with large amounts of moisture in the soil a material that would not rust and would be resistant to water damage may be chosen to supplement steel, such as a fiberglass. The material used to construct the foundation may be any combination of materials including, but not limited to, a metal, a composite (e.g., carbon structures), a ceramic, or a plastic. The fill may be any particulate, such as, for example, soil or aggregate.

The foundation may include any number of sensors 460 adapted to detect conditions of and within the foundation. These sensors 460 may be positioned inside the foundation structure 400. For example, one or more sensors 460 may be placed within the foundation structure in order to detect the condition of the backfill and/or the material used to construct the foundation structure. Further, one or more sensors 462 may be placed on the exterior of the foundation in order to detect the condition of the soil surrounding the foundation and/or the material used to construct the foundation, including the foundation structure. Mechanical strain sensors and fatigue sensors may be placed in contact with portions of structural members 420 susceptible to high strain. The sensors 460, 462 may include, but are not limited to, a mechanical strain sensor, a fatigue sensor, a moisture sensor, and a corrosion sensor (e.g., cathodic electrical potential sensors, etc.). The foundation may also include a cathodic protection system coupled to the foundation structure (not shown).

Figure 4:
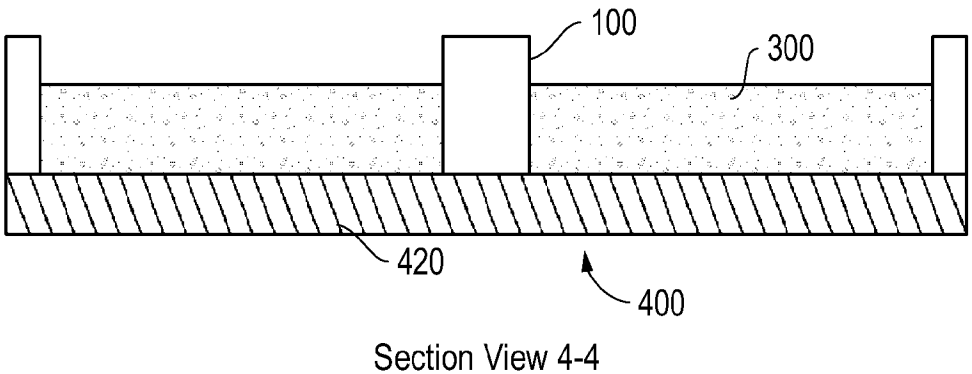
FIG. 4 is a cross sectional view of a foundation according to an embodiment of the invention.

Referring to FIG. 4, once the foundation structure is positioned (for example, in the excavated pit), the voids 410 of the foundation structure are filled with non-cementitious fill 300 to provide mass and ballast for the foundation. The fill 300 placed into the foundation structure may be, at least partially, comprised of local materials. The local materials may be from the excavation of the pit into which the foundation structure is placed. The type of fill 300 used will, therefore, depend on the local geology of the construction site. If the site is has a rock substrate, the fill 300 may consist of aggregate, which may be cleaned and conditioned prior to placement in the foundation. If the site has a predominately soil substrate, the foundation may comprise fill 300 consisting of local soils. Likewise, mixed substrates may produce a fill 300 comprising mixed rock and soil. This mixed substrate may be cleaned and conditioned prior to use. It will be appreciated that the fill 300 may be chosen from a range of possible materials depending the type of substrate found at the construction site. Cementitious, as used herein, refers to cement or concrete in solid form. Thus, pre-existing solid concrete that has been reduced to rubble is considered non-cementitious, and may be used in some implementations.

Although concrete foundations are typically left in the ground after a site is decommissioned, aspects of the present invention disclosed herein allow easier cleanup and decommissioning of the site because the foundation structure may be removed cost-effectively. In some aspects, the foundation structure may be reused at another site. The ease of removal provided by aspects of the invention enable accurate evaluation of available wind power by providing a cost effective solution to install a full-sized tower and turbine at a site prior to full scale construction and cost-effective removal of the tower and foundation if turbine performance shows the available wind at the site is not suitable for full scale power production.

In another embodiment, the invention comprises a method for constructing a foundation for a tower. The foundation is constructed by excavating a pit of a sufficient size to contain the foundation structure. In some embodiments, the depth of the excavated pit is sufficient to contain the foundation structure with a top of the foundation structure located within plus or minus 3 feet of the ground surface. The backfill from the excavation may be reserved. In one embodiment, a foundation structure, such as that described above, is assembled inside the excavated pit from a kit including pre-fabricated pieces. In another embodiment, the foundation structure, such as the one above, is positioned in the pit at least partially pre-assembled. The partially (or entirely) pre-assembled foundation structure may be fabricated beforehand at a remote location for transport to the construction site, removing fabrication of these elements from the project's critical path. In some implementations (at construction sites with rocky ground or caliche-type soils, for example), the foundation structure is positioned on leveled ground with no excavation performed. Avoiding excavation could reduce costs, particularly in areas where excavation is problematic.

Any suitable method or combination of methods for fastening the components of the foundation may be used, including but not limited to: bolts, studs, welding and threaded receivers. In one embodiment, the prefabricated pieces of the foundation structure are fitted together inside the excavated pit or on top of leveled ground at the site and are connected by bolting the pieces together with suitably sized threaded fasteners.

Construction of the foundation is continued by filling the storage tank 400 of the assembled foundation structure with non-cementitious fill 300 to provide the mass and ballast to stabilize the foundation and the structure to be erected upon the foundation. The storage tank 400 may be filled with a volume of non-cementitious fill 300 such that the weight of the volume of fill is sufficient to counteract expected lifting forces, as described above. The foundation structure 400 may be filled with the backfill reserved from the excavation process. Construction of the foundation may also include enclosing the storage tank 400 after filling the storage tank with the non-cementitious fill 300. For example, top 440 (described above with reference to FIG. 3) may be positioned and attached to the storage tank 400 after filling the storage tank.

Constructing the foundation according to aspects of the invention may take as little time as one to two days, in contradistinction with previous methods of tower construction in which tying rebar for the concrete foundation may take weeks. By minimizing the window for construction, weather delays are reduced. Also, the impact of cold, rain, and heat regarding pouring and curing cement are eliminated. Prefabrication of foundation elements also decreases costs by reducing the size of the required labor force at the site.

Aspects of the present invention include a non-cementitious tower foundation structure kit. The foundation structure kit includes components for constructing the foundation structure discussed herein. The foundation structure kit includes one or more shaft components configured to be assembled as a central shaft 100. The kit also includes one or more storage tank components configured to be assembled as a storage tank 400 disposed proximate to the central shaft 100, with the storage tank 400 configured to contain non-cementitious fill 300 as ballast to stabilize the central shaft 100. The storage tank components may include components for forming the peripheral shell 430, the bottom member 420 and the top 440, as described above. Components may be packaged in space-saving or easily handled configurations for storage and shipment. The kit also includes structural members 200 configured to be coupled to the central shaft 100 for transferring compression loads and tension loads from the central shaft 100 to the storage tank 400.

It should be understood that the inventive concepts disclosed herein are capable of many modifications. Such modifications may include types of materials, specific tools and mechanisms used, and so on. To the extent such modifications fall within the scope of the appended claims and their equivalents, they are intended to be covered by this patent.

The invention claimed is:

1. A non-cementitious tower foundation structure comprising:

a central shaft;

a storage tank disposed proximate the central shaft, the storage tank comprising one or more voids for containing non-cementitious fill as ballast to stabilize the central shaft, the storage tank further comprising a peripheral shell; and a plurality of radially extending structural members, the structural members coupling the central shaft to the storage tank, the structural members comprising a to surface corresponding to the to surface of the peripheral shell and adjacent side surfaces, the side surfaces spanning the depth of the peripheral shell along the entire length of said structural members.

2. The foundation structure of claim 1 wherein the total volume capacity of the one or more voids is at least a threshold volume.

3. The foundation structure of claim 2 wherein the threshold volume comprises a volume of a particular fill of a particular average density such that the weight of the volume of the particular fill is sufficient to counteract expected tension-based lifting forces.

4. The foundation structure of claim 2 wherein the storage tank comprises a bottom member including a top surface, the bottom member comprising material of sufficient strength and thickness to support at least the weight of the threshold volume of fill.

5. The foundation structure of claim 4 wherein the peripheral shell comprises a bottom surface, the bottom surface attached to the perimeter of the top surface of the bottom member.

6. The foundation structure of claim 1 further comprising a fastening member located at the to of the central shaft, the fastening member connecting the foundation structure to the base of a tower.

7. The foundation structure of claim 5 wherein the structural members couple the central shaft to the peripheral shell.

8. The foundation structure of claim 4 wherein the structural members couple the central shaft to the bottom member of the storage tank.

9. The foundation structure of claim 1 wherein the structural members are coupled to the central shaft and the storage tank by at least one of the group of bolts, studs and threaded receivers.

10. The foundation structure of claim 1 wherein the structural members are coupled to the central shaft and the storage tank by welds.

11. The foundation structure of claim 1 wherein the storage tank comprises an enclosed shell including a top.

12. The foundation structure of claim 10 wherein the structural members couple the central shaft to the top of the storage tank.

13. The foundation structure of claim 1 wherein the storage tank is substantially cylindrical.

14. The foundation structure of claim 4 wherein the bottom comprises a steel plate.

15. The foundation structure of claim 7 wherein the structural members comprise a plurality of steel plates.

16. The foundation structure of claim 1 further comprising one or more sensors within the storage tank configured to detect a condition of the foundation.

17. The foundation structure of claim 16 wherein the one or more sensors comprise mechanical strain sensors.

18. The foundation structure of claim 16 wherein the one or more sensors comprise fatigue sensors.

19. The foundation structure of claim 16 wherein the one or more sensors comprise corrosion sensors.

20. A tower foundation comprising:

the foundation structure of claim 1 positioned inside an excavated pit; and a volume of non-cementitious fill such that the weight of the volume of fill is sufficient to counteract an expected tension load transferred to the storage tank from the central shaft.

21. The foundation of claim 20 wherein the depth of the excavated pit is sufficient to contain the foundation structure with a top of the foundation structure located within plus or minus 3 feet of the ground surface.

22. The foundation of claim 20 wherein the fill comprises aggregate.

23. The foundation of 22, wherein the aggregate comprises local materials.

* * * * *